US011709458B2

(12) United States Patent
Suzuki et al.

(10) Patent No.: US 11,709,458 B2
(45) Date of Patent: Jul. 25, 2023

(54) IMAGE FORMING APPARATUS CAPABLE OF DOUBLE-SIDE PRINTING

(71) Applicant: Brother Kogyo Kabushiki Kaisha, Nagoya (JP)

(72) Inventors: Keita Suzuki, Nishio (JP); Shota Iriyama, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/653,140

(22) Filed: Mar. 2, 2022

(65) Prior Publication Data

US 2022/0299935 A1 Sep. 22, 2022

(30) Foreign Application Priority Data

Mar. 22, 2021 (JP) ..... 2021-047852

(51) Int. Cl.
*G03G 15/00* (2006.01)
*G03G 21/20* (2006.01)
*G03G 15/06* (2006.01)

(52) U.S. Cl.
CPC ..... *G03G 21/203* (2013.01); *G03G 15/065* (2013.01)

(58) Field of Classification Search
CPC .. G03G 15/065; G03G 15/167; G03G 15/169; G03G 15/1615; G03G 21/203
USPC ..... 399/38, 44, 53, 55
See application file for complete search history.

(56) References Cited

U.S. PATENT DOCUMENTS 7,817,929 B2 * 10/2010 Booth ..... G03G 15/065 347/116
9,122,243 B2 * 9/2015 Miyaji ..... G03G 21/206
2008/0019715 A1 1/2008 Furukawa et al.
2009/0297183 A1 12/2009 Miyahara

FOREIGN PATENT DOCUMENTS

JP 2008-026470 A 2/2008
JP 2009-288550 A 12/2009

* cited by examiner

*Primary Examiner* — Hoan H Tran
(74) *Attorney, Agent, or Firm* — Burr Patent Law, PLLC

(57) ABSTRACT

An image forming apparatus includes a photoconductive drum, a developing roller, a humidity sensor configured to detect a humidity, and a controller configured to execute a single-side printing, a first-double-side printing and a second double-side printing. The controller is configured to execute the first double-side printing in which images are printed at a first developing-bias voltage on both the first surface and the second surface of the sheet when the humidity detected by the humidity sensor is greater than a threshold value. The controller is configured to execute the second double-side printing in which an image is printed at a second developing-bias voltage, which is less than the first developing-bias voltage, on the second surface of the sheet when the humidity detected by the humidity sensor is equal to or less than the threshold value.

18 Claims, 4 Drawing Sheets

IMAGE FORMING APPARATUS CAPABLE OF DOUBLE-SIDE PRINTING

CROSS REFERENCE TO RELATED APPLICATION

The present application claims priority from Japanese Patent Application No. 2021-047852, which was filed on Mar. 22, 2021, the disclosure of which is herein incorporated by reference in its entirety.

BACKGROUND

The following disclosure relates to an image forming apparatus.

There has been known a conventional image forming apparatus capable of switching a printing mode between a single-side printing mode and a double-side printing mode. The image forming apparatus applies a first developing-bias voltage to a developing roller in the single-side printing mode, and applies a second developing-bias voltage, which is less than the first developing-bias voltage, to the developing roller in printing on a second surface of a sheet in the double-side printing mode.

SUMMARY

According to the image forming apparatus, a reducing rate of the second developing-bias voltage with respect to the first developing-bias voltage (a decreasing rate of a developing-bias voltage) is set based on a coefficient in accordance with a relative humidity. More specifically, the reducing rate of the developing-bias voltage is set based on a linear function of the reducing rate of the developing-bias voltage related to the relative humidity.

As a result, there is a possibility that the developing-bias voltage is reduced in a humidity situation where there is no need to reduce the developing-bias voltage.

An aspect of the disclosure relates to an image forming apparatus capable of suppressing an occurrence of a deterioration of image quality based on a transfer residual toner, namely an occurrence of a transfer residual toner ghost, without reducing a density of printing.

In one aspect of the disclosure, an image forming apparatus includes a photoconductive drum, a developing roller, a humidity sensor configured to detect a humidity, and a controller configured to execute a single-side printing in which an image is printed at a first developing-bias voltage on only a first surface of a sheet, a first double-side printing in which images are printed at the first developing-bias voltage on both the first surface and a second surface of the sheet when the humidity detected by the humidity sensor is greater than a threshold value, and a second double-side printing in which an image is printed at a second developing-bias voltage, which is less than the first developing-bias voltage, on the second surface of the sheet when the humidity detected by the humidity sensor is equal to or less than the threshold value.

In another aspect of the disclosure, an image forming apparatus includes a photoconductive drum, a developing roller, a humidity sensor configured to detect a humidity, and a controller configured to execute a single-side printing in which an image is printed on only a first surface of a sheet, a first double-side printing in which an image is printed at a first developing-bias voltage on a second surface of the sheet when the humidity detected by the humidity sensor is greater than a threshold value, and a second double-side printing in which an image is printed at a second developing-bias voltage, which is less than the first developing-bias voltage, on the second surface of the sheet when the humidity detected by the humidity sensor is equal to or less than the threshold value.

In another aspect of the disclosure, an image forming apparatus includes a controller configured to execute a single-side printing in which an image is printed on only a first surface of a sheet, a first double-bias printing in which images are printed at a first developing-bias voltage on both the first surface and a second surface of the sheet when the humidity detected by the humidity sensor is greater than a threshold value, and a second double-bias printing in which an image is printed at a second developing-bias voltage on the first surface of the sheet and an image is printed at a third developing-bias voltage, which is less than the second developing-bias voltage, on the second surface of the sheet when the humidity detected by the humidity sensor is equal to or less than the threshold value.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Outline of Image Forming Apparatus

Figure 1:
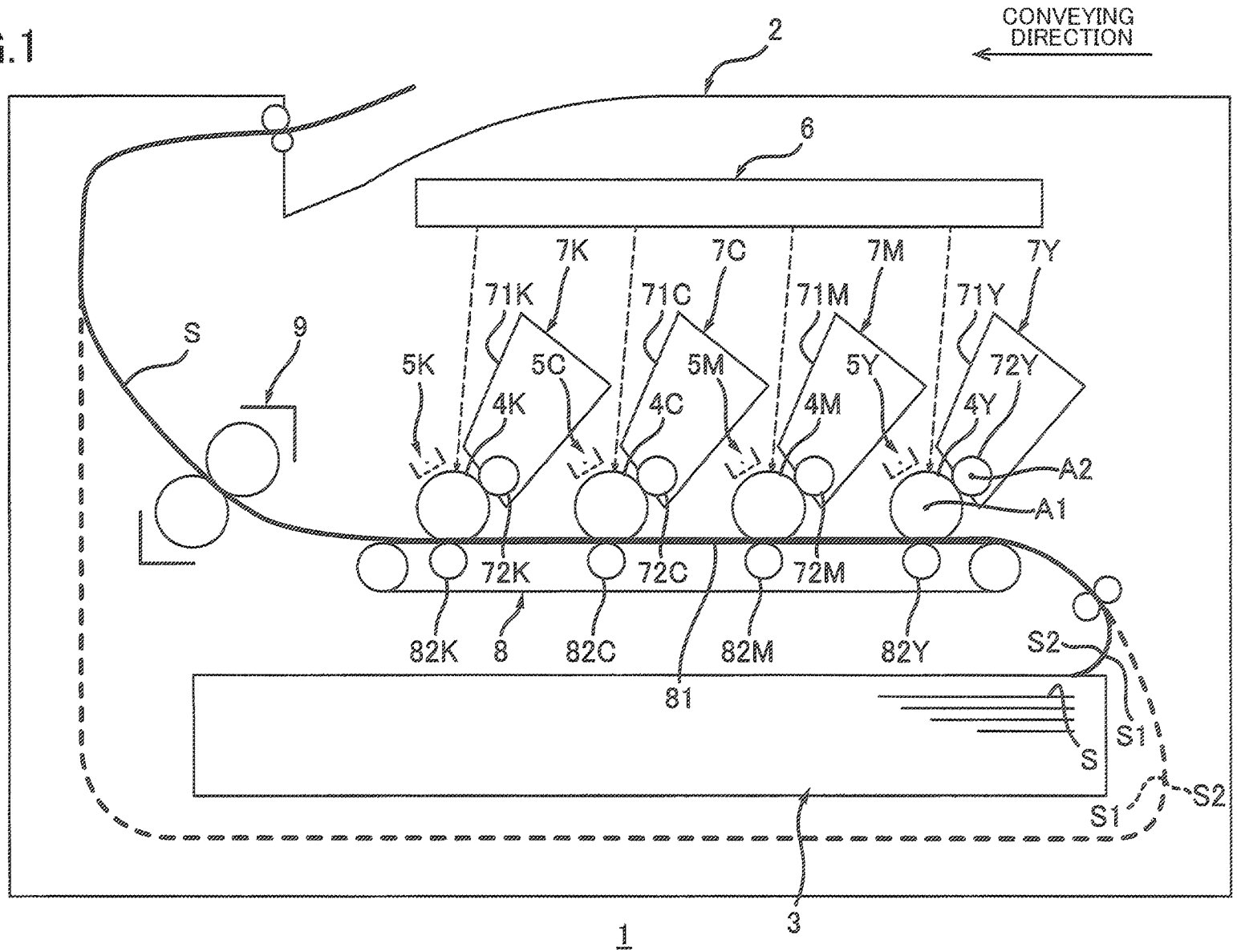
FIG. 1 is a view of a configuration of an outline of an image forming apparatus.

There will be described an outline of an image forming apparatus with reference to FIG. 1.

The image forming apparatus 1 includes a body housing 2, a sheet accommodating portion 3, a plurality of photoconductive drums 4Y, 4M, 4C, 4K, a plurality of charging units 5Y, 5M, 5C, 5K, an exposing unit 6, a plurality of developing cartridges 7Y, 7M, 7C, 7K, a transfer unit 8, and a fixing unit 9.

Body Housing

The body housing 2 accommodates the sheet accommodating portion 3, the plurality of photoconductive drums 4Y, 4M, 4C, 4K, the plurality of charging units 5Y, 5M, 5C, 5K, the exposing unit 6, the plurality of developing cartridges 7Y, 7M, 7C, 7K, the transfer unit 8, and the fixing unit 9.

Sheet Accommodating Portion

The sheet accommodating portion 3 accommodates a plurality of sheets S. The sheet S in the sheet accommodating portion 3 is conveyed from the sheet accommodating portion 3 toward the photoconductive drum 4Y. The sheet S is, for example, a printing sheet. The sheet accommodating portion 3 may be a sheet cassette.

Photoconductive Drum

The plurality of photoconductive drums 4Y, 4M, 4C, 4K are arranged in a conveying direction of the sheet S by a belt 81. The belt 81 will be described below.

The photoconductive drum 4Y extends in an axial direction of the photoconductive drum 4Y. The photoconductive drum 4Y is rotatable about a drum axis A1. The drum axis A1 extends in the axial direction of the photoconductive drum 4Y.

The explanation of each of the photoconductive drums 4M, 4C, 4K is the same as the explanation of the photoconductive drum 4Y. Accordingly, the explanation of each of the photoconductive drums 4M, 4C, 4K is dispensed with.

Charging Unit

The charging unit 5Y charges the photoconductive drum 4Y. The charging unit 5M charges the photoconductive drum 4M. The charging unit 5C charges the photoconductive drum 4C. The charging unit 5K charges the photoconductive drum 4K. In the present embodiment, each of the plurality of charging units 5Y, 5M, 5C, 5K is a scorotron type charging unit. Each of the plurality of charging units 5Y, 5M, 5C, 5K may be a charging roller.

Exposing Unit

The exposing unit 6 exposes the photoconductive drum 4Y charged by the charging unit 5Y. In the present embodiment, the exposing unit 6 is a laser scan unit. The exposing unit 6 can expose not only the photoconductive drum 4Y, but also the photoconductive drums 4M, 4C, 4K. The exposing unit 6 may be an exposing head including a LED array.

Developing Cartridge

Each of the plurality of developing cartridges 7Y, 7M, 7C, 7K is mountable on the body housing 2.

The developing cartridge 7Y includes a developing housing 71Y and a developing roller 72Y. In other words, the image forming apparatus 1 includes the developing roller 72Y.

The developing housing 71Y accommodates a toner. The toner is a nonmagnetic one component toner capable of being charged by friction. In the present embodiment, the toner is positively charged by friction.

The developing roller 72Y is supported by the developing housing 71Y. In a state in which the developing cartridge 7Y is mounted on the body housing 2, the developing roller 72Y is capable of supplying the toner in the developing housing 71Y to the photoconductive drum 4Y. The developing roller 72Y extends in an axial direction of the developing roller 72Y. The developing roller 72Y is rotatable about a development axis A2. The development axis A2 extends in the axial direction of the developing roller 72Y.

The explanation of each of the developing cartridges 7M, 7C, 7K is the same as the explanation of the developing cartridge 7Y. Accordingly, the explanation of each of the developing cartridges 7M, 7C, 7K is dispensed with.

Transfer Unit

The transfer unit 8 includes the belt 81 and a plurality of transfer rollers 82K, 82Y, 82M, 82C.

The belt 81 is in contact with the plurality of photoconductive drums 4Y, 4M, 4C, 4K. The belt 81 conveys the sheet S which is conveyed from the sheet accommodating portion 3 toward the fixing unit 9. The belt 81 conveys the sheet S from the photoconductive drum 4Y toward the photoconductive drum 4K.

The transfer roller 82Y transfers the toner born on the photoconductive drum 4Y on the sheet S which is being conveyed by the belt 81. The transfer roller 82M transfers the toner born on the photoconductive drum 4M on the sheet S which is being conveyed by the belt 81. The transfer roller 82C transfers the toner born on the photoconductive drum 4C on the sheet S which is being conveyed by the belt 81. The transfer roller 82K transfers the toner born on the photoconductive drum 4K on the sheet S which is being conveyed by the belt 81.

Fixing Unit

The fixing unit 9 heats and pressurizes the sheet S on which the toner is transferred so at to fix the toner on the sheet S. The sheet S which has passed the fixing unit 9 is discharged on an upper surface of the body housing 2.

Details of Image Forming Apparatus

Next, there will be described the image forming apparatus 1 in detail with reference to FIG. 2.

Figure 2:
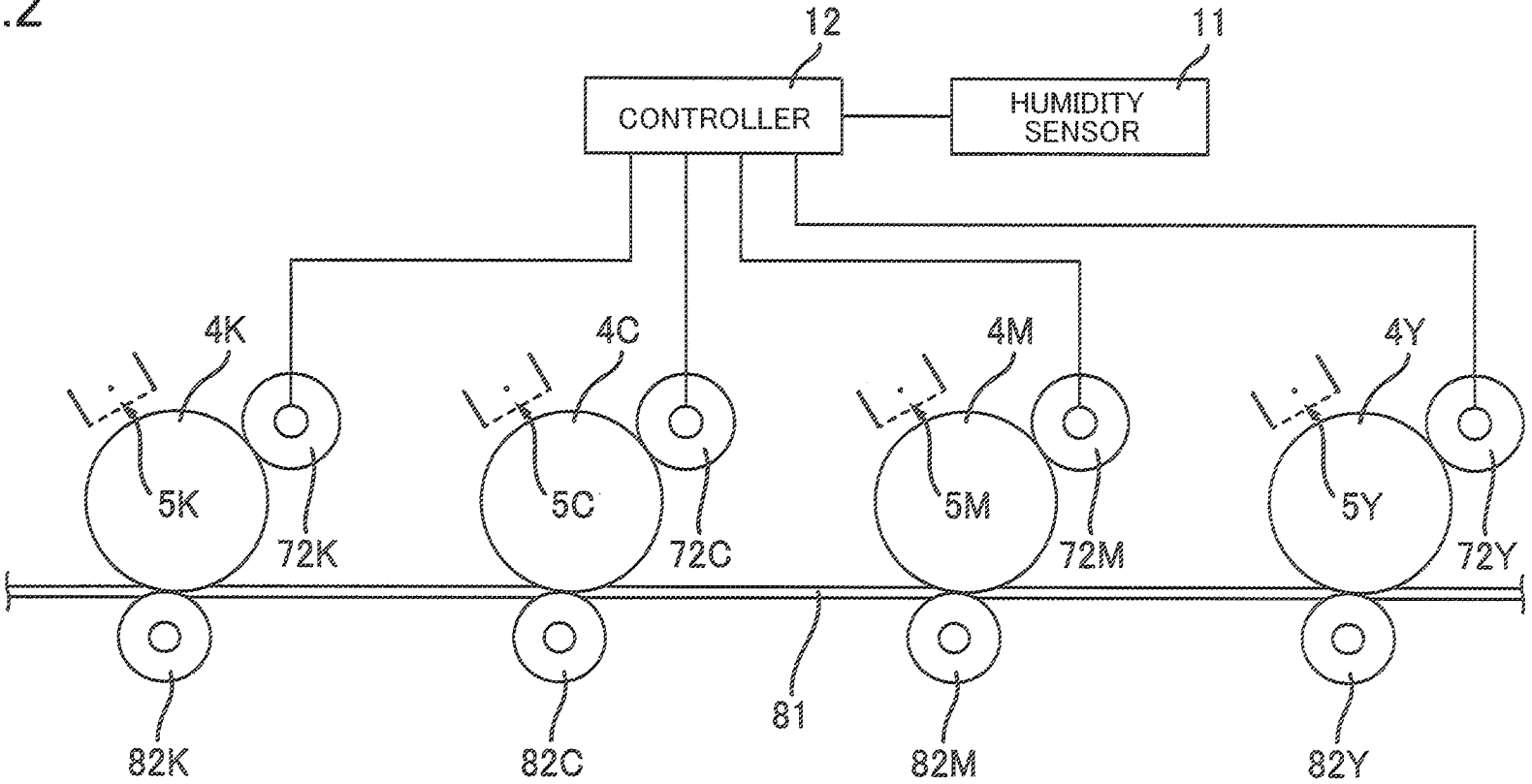
FIG. 2 is a view for explaining electrical connections among a humidity sensor, a controller, and a plurality of rollers.

As illustrated in FIG. 2, the image forming apparatus 1 includes a humidity sensor 11 and a controller 12.

Humidity Sensor

The humidity sensor 11 detects a humidity. In the present embodiment, the humidity sensor 11 detects a humidity of an outside of the body housing 2. "The humidity of the outside of the body housing 2" is a humidity, for example, in a room where the image forming apparatus 1 is placed. It is noted that the humidity sensor 11 may detect a humidity of an inside of the body housing 2.

Controller

The controller 12 is electrically connected to the humidity sensor 11. Accordingly, the controller 12 can obtain the humidity detected by the humidity sensor 11. Moreover, the controller 12 is electrically connected to each of the developing rollers 72Y, 72M, 72C, 72K. The controller 12 controls each of a developing-bias voltage Vb (Y) applied to the developing roller 72Y, a developing-bias voltage Vb (M) applied to the developing roller 72M, a developing-bias voltage Vb (C) applied to the developing roller 72C, and a developing-bias voltage Vb (K) applied to the developing roller 72K.

Control of Image Forming Apparatus

Next, there will be described a control of the image forming apparatus 1 by the controller 12 with reference to FIG. 1, FIG. 3, and FIG. 4.

When the controller 12 obtains a print job, the controller 12 executes a printing process. The controller 12 can execute a single-side printing process (S3) and a double-side printing process (S6) as the printing process.

Single-Side Printing Process

Figure 3:
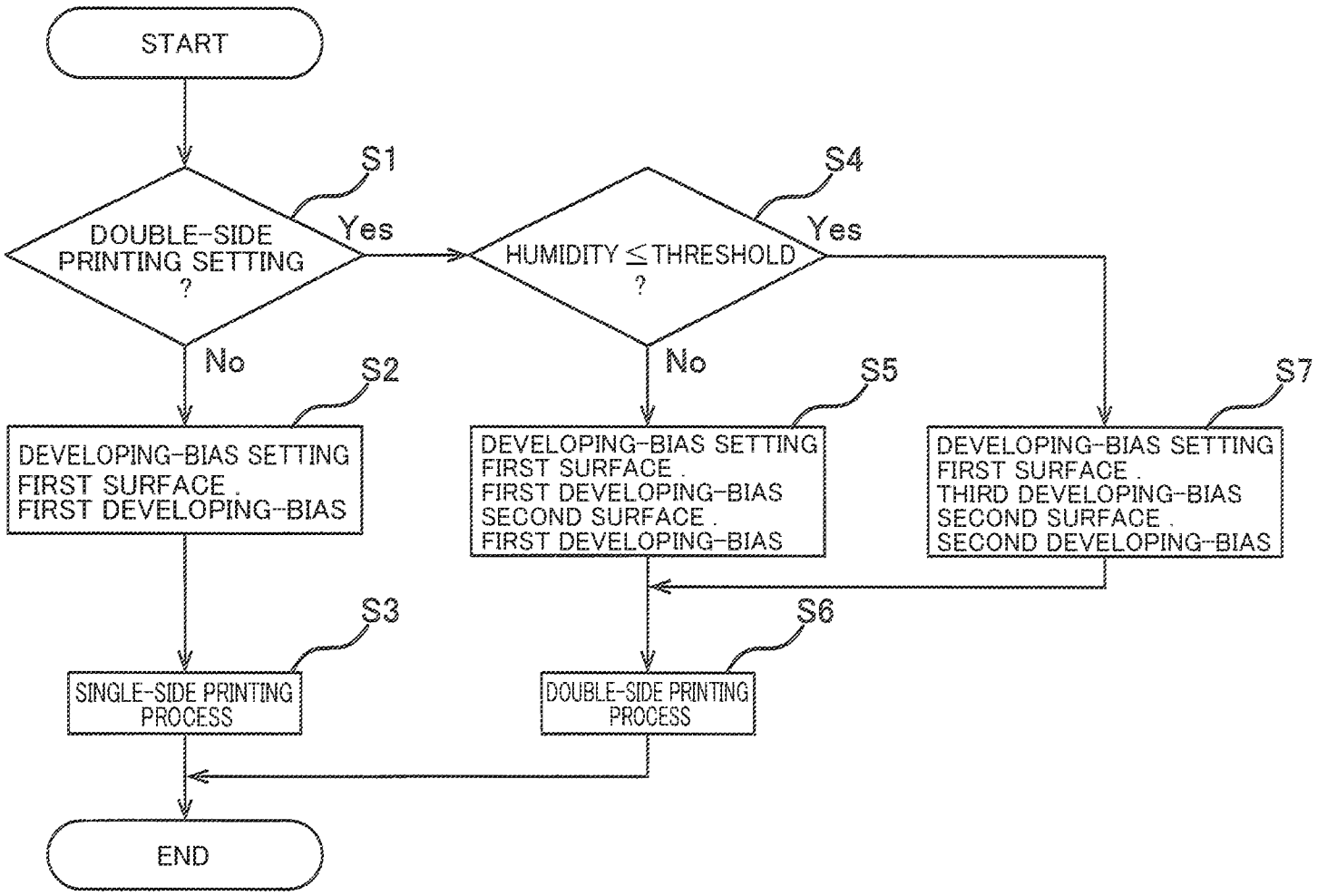
FIG. 3 is a flow chart for explaining a control of the image forming apparatus.

As illustrated in FIG. 3, in a case where a setting executing the double-side printing is not set for the print job (S1: NO), the controller 12 sets a target value of the developing-bias voltage Vb (Y) to a first developing-bias voltage Vb (Y1), sets a target value of the developing-bias voltage Vb (M) to a first developing-bias voltage Vb (M1), sets a target value of the developing-bias voltage Vb (C) to a first developing-bias voltage Vb (C1), and sets a target value of the developing-bias voltage Vb (K) to a first developing-bias voltage Vb (K1) (S2).

Next, the controller 12 executes the single-side printing process (S3). The processes in the single-side printing process at S2 and S3 in which an image is printed at the first developing-bias voltage on the first surface S1 of the sheet S are examples of a single-side printing.

In a case where the controller 12 executes the single-side printing process (S3), the image forming apparatus 1 forms the image only on a first surface S1 of the sheet S as indicated by a solid line illustrated in FIG. 1. In this case, the controller 12 adjusts the developing-bias voltage Vb (Y) so as to become the first developing-bias voltage Vb (Y1), adjusts the developing-bias voltage Vb (M) so as to become the first developing-bias voltage Vb (M1), adjusts the developing-bias voltage Vb (C) so as to become the first developing-bias voltage Vb (C1), and adjusts the developing-bias voltage Vb (K) so as to become the first developing-bias voltage Vb (K1). That is, the controller 12 applies the first developing-bias voltage Vb (Y1) to the developing roller 72Y in the single-side printing process (S3).

Double-Side Printing Process

As illustrated in FIG. 3, in a case where the setting executing the double-side printing is set for the print job (S1: YES), the controller 12 executes the double-side printing process (S6). In a case where the controller 12 executes the double-side printing process (S6), the image forming apparatus 1 forms the images on both the first surface S1 of the sheet S and a second surface S2 of the sheet S.

More specifically, the image forming apparatus 1 firstly forms the image on the first surface S1 of the sheet S as indicated by the solid line illustrated in FIG. 1.

Next, the image forming apparatus 1 conveys the sheet S which has passed the fixing unit 9 so that a trailing end of the sheet S is directed toward the photoconductive drum 4Y as indicated by a broken line illustrated in FIG. 1, and forms the image on the second surface S2 of the sheet S.

Here, in a case where, for example, the photoconductive drum 4Y and the transfer roller 82Y are explained, when the sheet S which has passed the fixing unit 9 passes a nip between the photoconductive drum 4Y and the transfer roller 82Y, there is a possibility of an occurrence of an electric discharge between the sheet S and the photoconductive drum 4Y.

More specifically, in low-humid surroundings in which a relative humidity is equal to or less than 40%, the sheet S is easily charged. As a result, there is the possibility of the occurrence of the electric discharge between the sheet S and the photoconductive drum 4Y. In a case where the image is formed on the second surface S2 of the sheet S which has passed the fixing unit 9, the electric discharge easily occurs especially in the low-humid surroundings in which the relative humidity is equal to or less than 40%. When the electric discharge occurs, a discharging state of the toner on the photoconductive drum 4Y changes. As a result, a transfer residual toner which is a toner remaining on the photoconductive drum 4Y and not being transferred on the sheet S occurs. There is a possibility of reduction in image quality when the transfer residual toner having occurred on the photoconductive drum 4Y is attached on the sheet S in a state in which the transfer residual toner is not cleaned. A transfer residual toner ghost is defined as a situation in which the image quality is reduced when the transfer residual toner having occurred is attached on the sheet S in the state in which the transfer residual toner is not cleaned.

It is noted that there is a possibility of the occurrence of the electric discharge between the transfer roller 82M and the photoconductive drum 4M, between the transfer roller 82C and the photoconductive drum 4C, and between the transfer roller 82K and the photoconductive drum 4K in the same way as the electric discharge between the transfer roller 82Y and the photoconductive drum 4Y.

Accordingly, as illustrated in FIG. 3, when executing the double-side printing process (S6) in the low-humid surroundings (S4: YES), the controller 12 reduces the developing-bias voltages Vb (Y), Vb (M), Vb (C), Vb (K) in printing on the second surface S2 of the sheet S (S7). There will be described below in detail.

Double-Side Printing Process in High-Humid Surroundings

In the case where the setting executing the double-side printing is set for the print job (S1: YES), the controller 12 sets target values of the developing-bias voltages Vb (Y), Vb (M), Vb (C), Vb (K) for printing on the first surface S1 of the sheet S and target values of the developing-bias voltages Vb (Y), Vb (M), Vb (C), Vb (K) for printing on the second surface S2 of the sheet S.

In the case where the setting executing the double-side printing is set for the print job (S1: YES), the controller 12 obtains the humidity from the humidity sensor 11 (S4).

Next, when the humidity detected by the humidity sensor 11 is greater than the threshold (S4: NO), the controller 12 sets each of the target values of the developing-bias voltages Vb (Y), Vb (M), Vb (C), Vb (K) for printing on the first surface S1 and the target values of the developing-bias voltages Vb (Y), Vb (M), Vb (C), Vb (K) for printing on the second surface S2 of the sheet S so as to be the same target values in the single-side printing process (S3) (S5).

More specifically, the controller 12 sets the target value of the developing-bias voltage Vb (Y) for printing on the first surface S1 to the first developing-bias voltage Vb (Y1), sets the target value of the developing-bias voltage Vb (M) for printing on the first surface S1 to the first developing-bias voltage Vb (M1), sets the target value of the developing-bias voltage Vb (C) for printing on the first surface S1 to the first developing-bias voltage Vb (C1), and sets the target value of the developing-bias voltage Vb (K) for printing on the first surface S1 to the first developing-bias voltage Vb (K1).

Moreover, the controller 12 sets the target value of the developing-bias voltage Vb (Y) for printing on the second surface S2 to the first developing-bias voltage Vb (Y1), sets the target value of the developing-bias voltage Vb (M) for printing on the second surface S2 to the first developing-bias voltage Vb (M1), sets the target value of the developing-bias voltage Vb (C) for printing on the second surface S2 to the first developing-bias voltage Vb (C1), and sets the target value of the developing-bias voltage Vb (K) for printing on the second surface S2 to the first developing-bias voltage Vb (K1).

In the present embodiment, the threshold is 40%.

Next, the controller 12 executes the double-side printing process (S6) as described above. The processes in the double printing process at S5 and S6 in which an image is printed at the first developing-bias voltage on the first surface S1 of the sheet S and an image is printed at the first developing-bias voltage on the second surface S2 of the sheet S when the humidity detected by the humidity sensor 11 is greater than the threshold value are examples of a first double-side printing. Moreover, the processes in the double-side printing process at S5 and S6 in which an image is printed at the first developing-bias voltage on the second surface S2 of the sheet S when the humidity detected by the humidity sensor 11 is greater than the threshold value are examples of a first double-side printing.

In a case where the image forming apparatus 1 forms the image on the first surface S1 of the sheet S, the controller 12 adjusts the developing-bias voltage Vb (Y) so as to become the first developing-bias voltage Vb (Y1), adjusts the developing-bias voltage Vb (M) so as to become the first developing-bias voltage Vb (M1), adjusts the developing-bias voltage Vb (C) so as to become the first developing-bias voltage Vb (C1), and adjusts the developing-bias voltage Vb (K) so as to become the first developing-bias voltage Vb (K1).

In a case where the image forming apparatus 1 forms the image on the second surface S2 of the sheet S, the controller 12 adjusts the developing-bias voltage Vb (Y) so as to become the first developing-bias voltage Vb (Y1), adjusts the developing-bias voltage Vb (M) so as to become the first developing-bias voltage Vb (M1), adjusts the developing-bias voltage Vb (C) so as to become the first developing-bias voltage Vb (C1), and adjusts the developing-bias voltage Vb (K) so as to become the first developing-bias voltage Vb (K1). That is, when the humidity detected by the humidity sensor 11 is greater than the threshold (S4: NO), the controller 12 applies the first developing-bias voltage Vb (Y1) to the developing roller 72Y in printing on the second surface S2 of the sheet S in the double-side printing process (S6).

Double-Side Printing in Low-Humid Surroundings

When the humidity detected by the humidity sensor 11 is equal to or less than the threshold (S4: YES), the controller 12 sets the target value of the developing-bias voltage Vb (Y) for printing on the second surface S2 to the second developing-bias voltage Vb(Y2), sets the target value of the developing-bias voltage Vb (M) for printing on the second surface S2 to the second developing-bias voltage Vb (M2), sets the target value of the developing-bias voltage Vb (C) for printing on the second surface S2 to the second developing-bias voltage Vb (C2), and sets the target value of the developing-bias voltage Vb (K) for printing on the second surface S2 to the second developing-bias voltage Vb (K2) (S7).

The second developing-bias voltage Vb (Y2) is less than the first developing-bias voltage Vb (Y1). Since the second developing-bias voltage Vb (Y2) is less than the first developing-bias voltage Vb (Y1), it is possible to reduce an amount of the toner supplied to the photoconductive drum 4Y. Accordingly, since the amount of the transfer residual toner is reduced, it is possible to suppress reduction in image quality.

Here, a difference ΔVb between the first developing-bias voltage Vb (Y1) and the second developing-bias voltage Vb (Y2) is calculated by the following first equation.

$$\Delta Vb = D \times b' \quad \text{the first equation}$$

In the first equation, D represents a target value of the density of printing, and b' represents a gradient calculated based on a measured density of a toner patch. The target value D of the density of printing is stored in a memory of the controller 12 as a data table with consideration of a printing environment. As the printing environment, for example, temperature, humidity, a kind of the sheet S and the like can be recited. The controller 12 reads a target value D specified in accordance with the printing environment.

Next, there will be described the gradient b' with reference to FIG. 4. As illustrated in FIG. 4, the image forming apparatus 1 forms a plurality of toner patches T1, T2, T3 on the belt 81 (see FIG. 1), and detects densities d1, d2, d3 of the plurality of toner patches T1, T2, T3 in a density correcting process. The density correcting process is executed, for example, every time when a total number of pages of printing reaches a predetermined number of pages, and the density correcting process is executed while the image forming apparatus 1 is not forming the image. The total number of pages of printing is a total number of pages which have been printed since the developing cartridge 7Y was exchanged. The toner patch T1 is a toner patch in a case where the developing-bias voltage Vb1 is applied to the developing roller 72Y, and the toner patch T2 is a toner patch in a case where the developing-bias voltage Vb2 is applied to the developing roller 72Y. The toner patch T3 is a toner patch in a case where the developing-bias voltage Vb3 is applied to the developing roller 72Y.

The controller 12 derives a function f (d) indicating a relationship between the developing-bias voltage and the density of the toner patch from the density d1 of the toner patch T1, the density d2 of the toner patch T2 and the density d3 of the toner patch T3.

Next, the controller 12 obtains the gradient b' by differentiating the function f (d) with the target value D. That is, b' is a gradient of a tangent t (d) of the function f (d) at the target value D.

Next, the controller 12 calculates the difference ΔVb between the first developing-bias voltage Vb (Y1) and the second developing-bias voltage Vb (Y2) from the first equation.

Next, the controller 12 calculates the second developing-bias voltage Vb (Y2) by subtracting ΔVb from the first developing-bias voltage Vb (Y1).

It is noted that each of the second developing-bias voltages Vb (M2), Vb (C2), Vb (K2) is calculated in the same way as the second developing-bias voltage Vb (Y2). That is, the second developing-bias voltage Vb (M2) is less than the first developing-bias voltage Vb (M1), the second developing-bias voltage Vb (C2) is less than the first developing-bias voltage Vb (C1), and the second developing-bias voltage Vb (K2) is less than the first developing-bias voltage Vb (K1).

Moreover, as illustrated in FIG. 3, when the humidity detected by the humidity sensor 11 is equal to or less than the threshold (S4: YES), the controller 12 sets the target value of the developing-bias voltage Vb (Y) for printing on the first surface S1 to a third developing-bias voltage Vb (Y3), sets the target value of the developing-bias voltage Vb (M) for printing on the first surface S1 to a third developing-bias voltage Vb (M3), sets the target value of the developing-bias voltage Vb (C) for printing on the first surface S1 to a third developing-bias voltage Vb (C3), and sets the target value of the developing-bias voltage Vb (K) for printing on the first surface S1 to a third developing-bias voltage Vb (K3) (S7).

The third developing-bias voltage Vb (Y3) is less than the first developing-bias voltage Vb (Y1). The third developing-bias voltage Vb (Y3) is preferably identical with the second developing-bias voltage Vb (Y2). Since the third developing-bias voltage Vb (Y3) is less than the first developing-bias voltage Vb (Y1), it is possible to reduce the amount of the toner supplied to the photoconductive drum 4Y. Accordingly, a density of printing on the first surface S1 can coincide with a density of printing on the second surface S2. It is noted that the third developing-bias voltage may be greater than the second developing-bias voltage.

It is noted that the third developing-bias voltage Vb (M3) is less than the first developing-bias voltage Vb (M1), the third developing-bias voltage Vb (C3) is less than the first developing-bias voltage Vb (C1), and the third developing-bias voltage Vb (K3) is less than the first developing-bias voltage Vb (K1).

Next, the controller 12 executes the double-side printing process (S6).

In the case where the image forming apparatus 1 forms the image on the first surface S1 of the sheet S, the controller 12 adjusts the developing-bias voltage Vb (Y) so as to become the third developing-bias voltage Vb (Y3), adjusts the developing-bias voltage Vb (M) so as to become the third developing-bias voltage Vb (M3), adjusts the developing-bias voltage Vb (C) so as to become the third developing-bias voltage Vb (C3), and adjusts the developing-bias voltage Vb (K) so as to become the third developing-bias voltage Vb (K3). That is, when the humidity detected by the humidity sensor 11 is equal to or less than the threshold (S4: YES), the controller 12 applies the third developing-bias voltage Vb (Y3) to the developing roller 72Y in printing on the first surface S1 of the sheet S in the double-side printing process (S6).

In the case where the image forming apparatus 1 forms the image on the second surface S2 of the sheet S, the controller 12 adjusts the developing-bias voltage Vb (Y) so as to become the second developing-bias voltage Vb (Y2), adjusts the developing-bias voltage Vb (M) so as to become the second developing-bias voltage Vb (M2), adjusts the developing-bias voltage Vb (C) so as to become the second developing-bias voltage Vb (C2), and adjusts the developing-bias voltage Vb (K) so as to become the second developing-bias voltage Vb (K2). That is, when the humidity detected by the humidity sensor 11 is equal to or less than the threshold (S4: YES), the controller 12 applies the second developing-bias voltage Vb (Y2) to the developing roller 72Y in printing on the second surface S2 of the sheet S in the double-side printing process (S6). The processes in the double-side process at S7 and S6 in which an image is printed at the second developing-bias voltage on the second surface S2 of the sheet S when the humidity detected by the humidity sensor 11 is equal to or less than the threshold value are examples of a second double-side printing. Moreover, the processes in the double-side printing process at S7 and S6 in which an image is printed at the third developing-bias voltage, which is greater than the second developing-bias voltage, on the first surface S1 of the sheet S and an image is printed at the second developing-bias voltage on the second surface S2 of the sheet S when the humidity detected by the humidity sensor 11 is equal to or less than the threshold value are examples of a second double-side printing.

It is noted that the controller 12 ends the printing process when all of the print jobs are completed.

Effects

According to the image forming apparatus 1, as illustrated in FIG. 3, when the humidity detected by the humidity sensor 11 is greater than the threshold (S4: NO), the developing-bias voltage is not reduced even in a case where the image is printed on the second surface S2 of the sheet S in the double-side printing process (S6). By contrast, when the humidity detected by the humidity sensor 11 is equal to or less than the threshold (S4: YES), the developing-bias voltage is reduced in the case where the image is printed on the second surface S2 of the sheet S in the double-side printing process (S6).

More specifically, when the humidity detected by the humidity sensor 11 is greater than the threshold (S4: NO), the first developing-bias voltage Vb (Y1) is applied to the developing roller 72Y even in the case where the image is printed on the second surface S2 of the sheet S in the double-side printing process (S6). When the humidity detected by the humidity sensor 11 is equal to or less than the threshold (S4: YES), the second developing-bias voltage Vb (Y2) which is less than the first developing-bias voltage Vb (Y1) is applied to the developing roller 72Y in the case where the image is printed on the second surface S2 of the sheet S in the double-side printing process (S6).

When the humidity detected by the humidity sensor 11 is greater than the threshold (S4: NO), there is little possibility of the occurrence of the transfer residual toner ghost. Since the developing-bias voltage is not reduced under the high-humid surroundings, it is possible to suppress reduction in the density of printing on the second surface S2. In other words, the density of printing is maintained.

By contrast, when the humidity detected by the humidity sensor 11 is equal to or less than the threshold (S4: YES), there is the possibility of the occurrence of the transfer residual toner ghost. Since the developing-bias voltage is reduced under the low-humid surroundings, it is possible to suppress the occurrence of the transfer residual toner ghost in printing on the second surface of the sheet S.

As a result, it is possible to suppress the occurrence of the transfer residual toner ghost while suppressing reduction in the density of printing. According to the image forming apparatus 1, the difference ΔVb between the first developing-bias voltage and the second developing-bias voltage is calculated by the following first equation.

$$\Delta Vb = D \times b' \qquad \text{the first equation}$$

Figure 4:
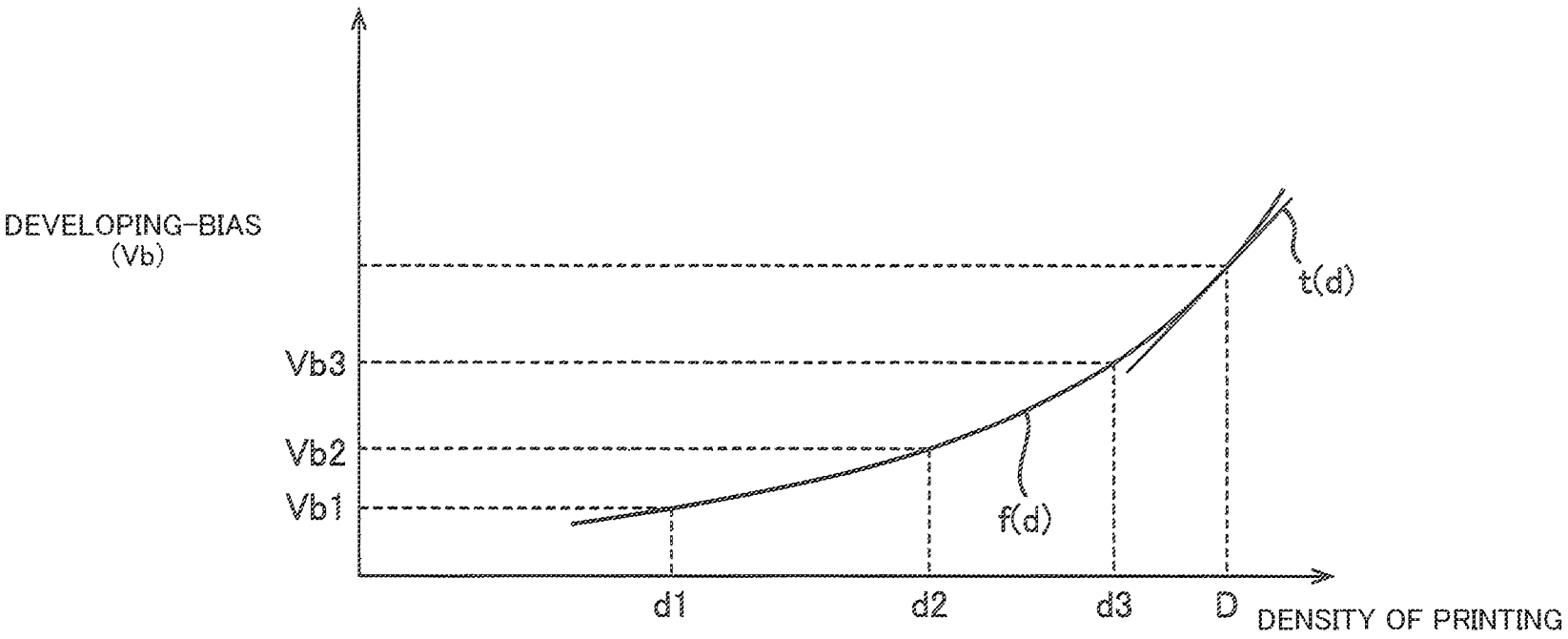
FIG. 4 a graph for explaining b' in a first equation.

As illustrated in FIG. 4, in the first equation, D represents the target value of the density of printing, and b' represents the gradient of the tangent t (d) of the quadratic function f (d), which is calculated based on the measured density of the toner patch, at the target value D.

As a result, it is possible to set the second developing-bias voltage by the difference ΔVb calculated from the measured density of the toner patch and the target value D of the density of printing. That is, it is possible to correct the difference ΔVb in accordance with the measured density of the toner patch.

Accordingly, it is possible to suppress reduction in the density of printing.

According to the image forming apparatus 1, as illustrated in FIG. 3, when the humidity detected by the humidity sensor 11 is equal to or less than the threshold (S4: YES), the developing-bias voltage is reduced in printing on the first surface S1 of the sheet S in the double-side printing process (S6).

More specifically, when the humidity detected by the humidity sensor 11 is equal to or less than the threshold (S4: YES), the third developing-bias voltage, which is less than the first developing-bias voltage, is applied in printing on the first surface S1 of the sheet S in the double-side printing process (S6).

Accordingly, it is possible to reduce the density of printing on the first surface S1 so that the density of printing on the first surface S1 coincides with the density of printing on the second surface S2.

As a result, it is possible to prevent that a difference in the density of printing between the first surface S1 and the second surface S2 excessively increases.

Modifications

Next, there will be described modifications. In the modifications, the same reference numerals as used in the above described embodiment are used to designate the corresponding components and processes of the modifications, and explanations of which are dispensed with.

The controller 12 may apply the first developing-bias voltage and the second developing-bias voltage to the developing roller so that the difference ΔVb between the first developing-bias voltage and the second developing-bias voltage becomes smaller as the humidity detected by the humidity sensor 11 becomes higher.

According to this modification, it is possible to increase the second developing-bias voltage as the humidity becomes higher and the possibility of the occurrence of the transfer residual toner ghost becomes smaller.

As a result, it is possible to suppress reduction in the density of printing more.

The controller 12 may set the gradient b' to an upper limit when the gradient b' becomes greater than the upper limit.

According to this modification, it is possible to prevent that the difference ΔVb excessively increases.

As a result, it is possible to suppress excessive reduction in the density of printing of the second surface S2 of the sheet S.

The image forming apparatus 1 may be an image forming apparatus, specialized to monochrome printing, not including the photoconductive drum 4Y, 4M, 4C.

The image forming apparatus 1 may include a drum unit having the plurality of photoconductive drums 4Y, 4M, 4C, 4K.

The image forming apparatus 1 may include a drum cartridge having the photoconductive drum 4Y, a drum cartridge having the photoconductive drum 4M, a drum cartridge having the photoconductive drum 4C, and a drum cartridge having the photoconductive drum 4K.

The image forming apparatus 1 may include a process cartridge having the photoconductive drum 4Y and the developing roller 72Y, a process cartridge having the photoconductive drum 4M and the developing roller 72M, a process cartridge having the photoconductive drum 4C and the developing roller 72C, and a process cartridge having the photoconductive drum 4K and the developing roller 72K.

Moreover, in the present embodiment, the controller 12 sets, at S5, the developing-bias voltage in printing on each of the first surface S1 and the second surface S2 of the sheet S to the first developing-bias voltage Vb (Y1) in the double-side printing, however, the present disclosure is not limited to this. For example, the controller 12 may set, at S5, the developing-bias voltage in printing on the second surface S2 of the sheet S to a developing-bias voltage, which is less than the first developing-bias voltage Vb (Y1) in printing on the first surface S1 of the sheet S in the double-side printing.

Moreover, in the present embodiment, the controller 12 sets, at S5, the developing-bias voltage in printing on the second surface S2 of the sheet S in the double-side printing to the first developing-bias voltage Vb (Y1), and sets, at S2, the developing-bias voltage in printing on the first surface S1 of the sheet S in the single-side printing to the same first developing-bias voltage Vb (Y1), however, the present disclosure is not limited to this. The controller may set, at S5, the developing-bias voltage in printing on the second surface S2 in the double-side printing to a voltage different from the first developing-bias voltage Vb (Y1) in printing on the first surface S1 of the sheet S in the single-side printing, for example, set a voltage less than the first developing-bias voltage Vb (Y1) in printing on the first surface S1 of the sheet S in the single-side printing. Furthermore, The controller may set, at S5, the developing-bias voltage in printing on the first surface S1 in the double-side printing to a voltage different from the first developing-bias voltage Vb (Y1) in printing on the first surface S1 of the sheet S in the single-side printing, for example, set a voltage less than the first developing-bias voltage Vb (Y1) in printing on the first surface S1 of the sheet S in the single-side printing.

What is claimed is:

1. An image forming apparatus, comprising:
a photoconductive drum;
a developing roller;
a humidity sensor configured to detect a humidity; and
a controller configured to execute:
a single-side printing in which an image is printed at a first developing-bias voltage on only a first surface of a sheet;
a first double-side printing in which images are printed at the first developing-bias voltage on both the first surface and a second surface of the sheet when the humidity detected by the humidity sensor is greater than a threshold value; and
a second double-side printing in which an image is printed at a second developing-bias voltage, which is less than the first developing-bias voltage, on the second surface of the sheet when the humidity detected by the humidity sensor is equal to or less than the threshold value.

2. The image forming apparatus according to claim 1, wherein the controller is configured to adjust the first developing-bias voltage and the second developing-bias voltage so that a difference between the first developing-bias voltage and the second developing-bias voltage becomes smaller as the humidity detected by the humidity sensor becomes higher.

3. The image forming apparatus according to claim 1, wherein a difference between the first developing-bias voltage and the second developing-bias voltage is calculated by an equation (1) below, wherein ΔVb represents the difference between the first developing-bias voltage and the second developing-bias voltage, D represents a target value of a density of printing, and b' represents a gradient calculated based on a measured density of a toner patch, $$\Delta Vb = D \times b' \quad (1).$$

4. The image forming apparatus according to claim 1, wherein the controller is configured to execute the second double-side printing in which an image is printed at a third developing-bias voltage, which is less than the first developing-bias voltage, on the first surface of the sheet when the humidity detected by the humidity sensor is equal to or less than the threshold.

5. The image forming apparatus according to claim 4, wherein the third developing-bias voltage is identical with the second developing-bias voltage.

6. The image forming apparatus according to claim 1, wherein the controller is configured to print the image on the second surface of the sheet after printing the image on the first surface of the sheet in the double-side printing.

7. An image forming apparatus, comprising:
a photoconductive drum;
a developing roller;
a humidity sensor configured to detect a humidity; and
a controller configured to execute:
a single-side printing in which an image is printed on only a first surface of a sheet;
a first double-side printing in which an image is printed at a first developing-bias voltage on a second surface of the sheet when the humidity detected by the humidity sensor is greater than a threshold value; and
a second double-side printing in which an image is printed at a second developing-bias voltage, which is less than the first developing-bias voltage, on the second surface of the sheet when the humidity detected by the humidity sensor is equal to or less than the threshold value.

8. The image forming apparatus according to claim 7, wherein the controller is configured to execute the first double-side printing in which an image is printed at the first developing-bias voltage on the first surface of the sheet when the humidity detected by the humidity sensor is greater than the threshold.

9. The image forming apparatus according to claim 7, wherein the controller is configured to execute the second double-side printing in which an image is printed at a third developing-bias voltage, which is less than the first developing-bias voltage, on the first surface of the sheet when the humidity detected by the humidity sensor is equal to or less than the threshold.

10. The image forming apparatus according to claim 9, wherein the third developing-bias voltage is identical with the second developing-bias voltage.

11. The image forming apparatus according to claim 7, wherein the controller is configured to print the image on the second surface of the sheet after printing the image on the first surface of the sheet in the double-side printing.

12. The image forming apparatus according to claim 7, wherein the controller is configured to execute a single-side printing in which an image is printed at the first developing-bias voltage on the first surface of the sheet.

13. The image forming apparatus according to claim 7, wherein the controller is configured to adjust the first developing-bias voltage and the second developing-bias voltage so that a difference between the first developing-bias voltage and the second developing-bias voltage becomes smaller as the humidity detected by the humidity sensor becomes higher.

14. The image forming apparatus according to claim 7, wherein a difference between the first developing-bias voltage and the second developing-bias voltage is calculated by an equation (1) below, where ΔVb represents the difference between the first developing-bias voltage and the second developing-bias voltage, D represents a target value of a density of printing, and b' represents a gradient calculated based on a measured density of a toner patch, $$\Delta Vb = D \times b' \quad (1).$$

15. An image forming apparatus, comprising:

a photoconductive drum;

a developing roller;

a humidity sensor configured to detect a humidity; and a controller configured to execute:

a single-side printing in which an image is printed on only a first surface of a sheet;

a first double-bias printing in which images are printed at a first developing-bias voltage on both the first surface and a second surface of the sheet when the humidity detected by the humidity sensor is greater than a threshold value; and a second double-bias printing in which an image is printed at a second developing-bias voltage on the first surface of the sheet and an image is printed at a third developing-bias voltage, which is less than the second developing-bias voltage, on the second surface of the sheet when the humidity detected by the humidity sensor is equal to or less than the threshold value.

16. The image forming apparatus according to claim 15, wherein the second developing-bias voltage is less than the first developing-bias voltage.

17. The image forming apparatus according to claim 15, wherein the controller is configured to adjust the first developing-bias voltage and the third developing-bias voltage so that a difference between the first developing-bias voltage and the third developing-bias voltage becomes smaller as the humidity detected by the humidity sensor becomes higher.

18. The image forming apparatus according to claim 15, wherein a difference between the first developing-bias voltage and the third developing-bias voltage is calculated by an equation (1) below, where ΔVb represents the difference between the first developing-bias voltage and the third developing-bias voltage, D represents a target value of a density of printing, and b' represents a gradient calculated based on a measured density of a toner patch, $$\Delta Vb = D \times b' \quad (1).$$

* * * * *